US005083391A

United States Patent [19]

Kyler

[11] Patent Number: 5,083,391

[45] **Date of Patent: * Jan. 28, 1992**

[54] DISPLAY AND DISPENSING APPARATUS

[76] Inventor: Arlene Kyler, 3445 Park Ave., Oceanside, N.Y. 11572

[ * ] Notice: The portion of the term of this patent subsequent to Mar. 1, 2005 has been disclaimed.

[21] Appl. No.: 609,600

[22] Filed: Nov. 6, 1990

Related U.S. Application Data

[63] Continuation of Ser. No. 365,044, Jun. 9, 1989, Pat. No. 4,967,496, which is a continuation of Ser. No. 125,376, Nov. 25, 1987, Pat. No. 4,839,976, which is a continuation of Ser. No. 829,829, Feb. 14, 1986, Pat. No. 4,727,666.

[51] Int. Cl.[5] ..... G09F 3/18

[52] U.S. Cl. ..... 40/642; 40/124.2; 40/493

[58] Field of Search ..... 40/124.2, 642, 661, 40/493, 657; 312/50, 59, 118; 211/52, 55, 70, 78, 128, 129, 77; 206/506; 220/447

[56] References Cited

U.S. PATENT DOCUMENTS

| | | | |
|---|---|---|---|
| D. 39,376 | 6/1908 | Berolzheimer | D6/455 |
| D. 65,640 | 9/1924 | Duff et al. | D6/455 |
| D. 76,662 | 10/1928 | Buchenau et al. | D6/455 |
| D. 85,692 | 12/1931 | Hamilton | D6/478 |
| D. 86,238 | 2/1932 | Kerchel | D6/457 |
| D. 99,539 | 5/1936 | Bodine et al. | D6/459 |
| D. 175,470 | 8/1955 | Kahn | D6/457 |
| D. 176,004 | 11/1955 | Brooks et al. | D6/476 |
| D. 371,457 | 10/1987 | Hersh | 108/60 |
| 429,893 | 6/1890 | Dahlstrom | 211/77 |
| 922,274 | 5/1909 | Gilmore | 40/124.2 |
| 929,714 | 8/1909 | Schlegel | 40/493 |
| 1,701,651 | 2/1929 | Zizka | 312/60 |
| 2,000,419 | 5/1935 | Sarber | 40/311 |
| 2,353,678 | 7/1944 | Lockwood | 220/447 |
| 2,754,166 | 7/1956 | Ohm | 312/140.4 |
| 3,331,515 | 7/1967 | Lange | 211/77 |
| 3,711,975 | 1/1973 | Downing | 40/506 |
| 3,983,649 | 10/1976 | Ellis et al. | 40/122 |
| 4,019,269 | 4/1977 | Vix | 40/660 |
| 4,244,512 | 1/1981 | Wise | 232/17 |
| 4,432,151 | 2/1984 | Morris | 40/661 |

FOREIGN PATENT DOCUMENTS

| | | |
|---|---|---|
| 593939 | 4/1925 | France . |
| 496280 | 2/1937 | United Kingdom . |

*Primary Examiner*—Cary E. O'Connor
*Attorney, Agent, or Firm*—Frishauf, Holtz Goodman & Woodward

[57] ABSTRACT

An apparatus which serves as both an advertising medium, for business cards as an example, and a means to dispense certain articles needed in a business establishment, comprises a multi-sided, substantially upright enclosure which includes walls upon which the business cards can be placed. In one embodiment, the enclosure is essentially a box with transparent sides, and the cards are placed against the inside surface of the walls. A supporting member for supporting the cards or other advertising media is inside and spaced from the enclosure to define a card receiving space. In another embodiment, a ledge is attached to the wall along with a bracing means to support it. The cards can be placed on the ledge where they are in view and from which then can be readily removed by an interested person. At the top of the enclosure in both embodiments is a receptacle where the articles, such as food products, are retained and from where they can be conveniently taken for use.

19 Claims, 6 Drawing Sheets

FIG. 3A
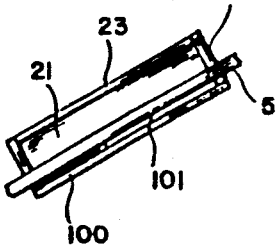
FIG. 2
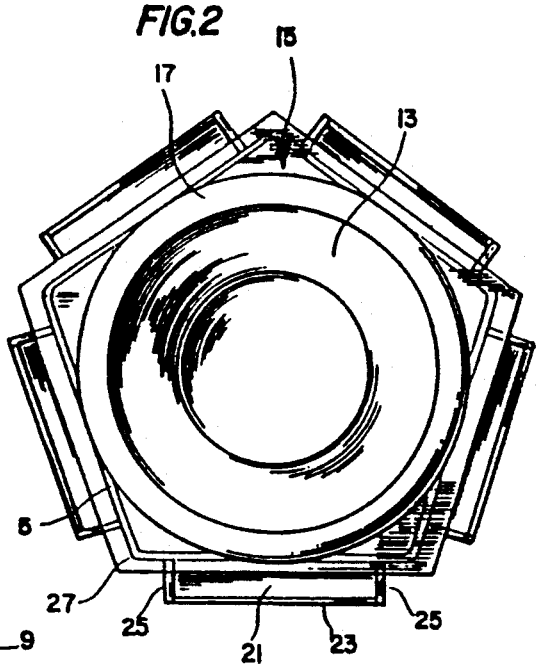
FIG. 3
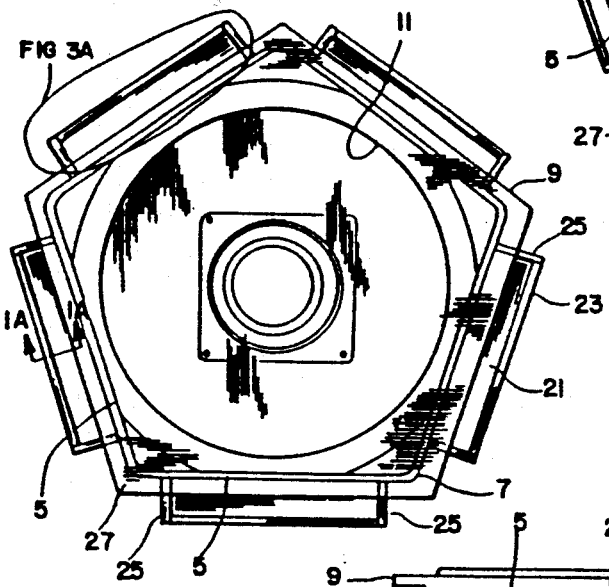
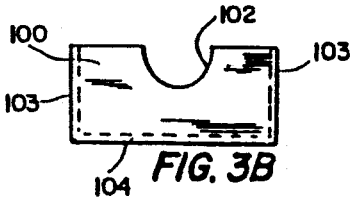
FIG. 3B
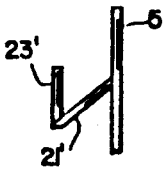
FIG. 1A
FIG. 17
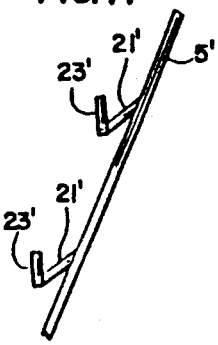
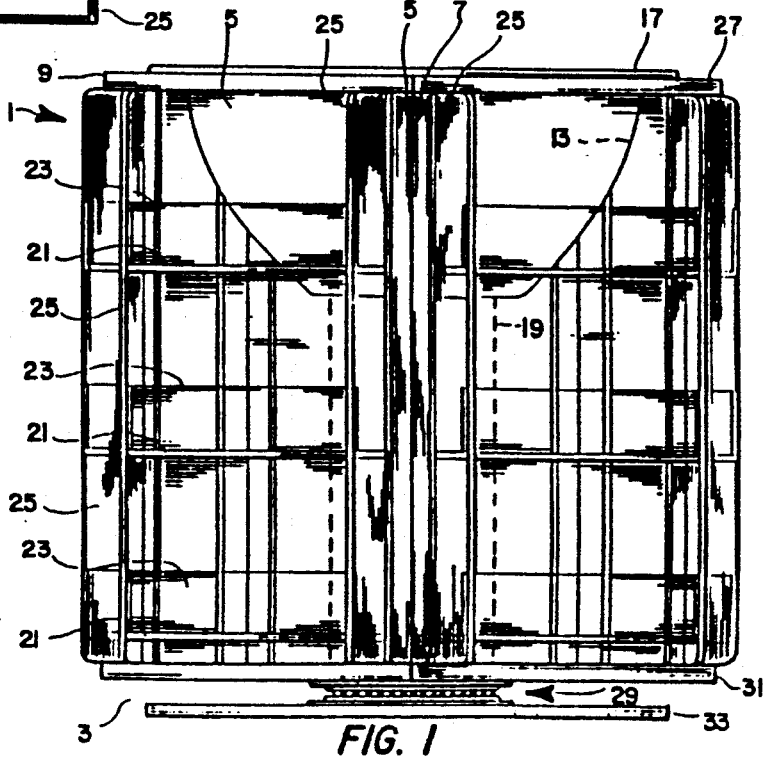
FIG. 1

FIG. 5
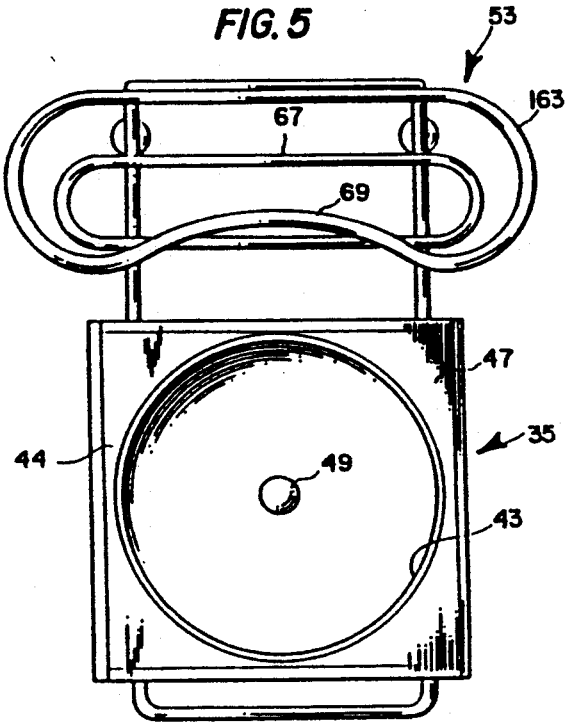
FIG. 8
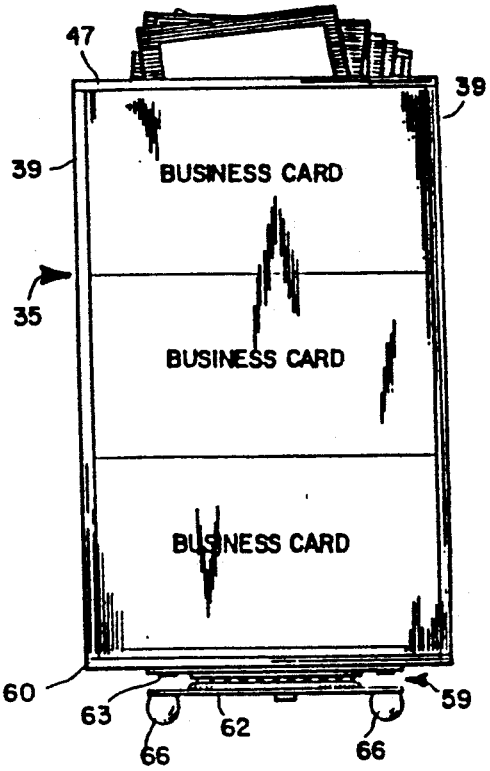
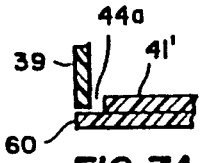
FIG. 7A
FIG. 7
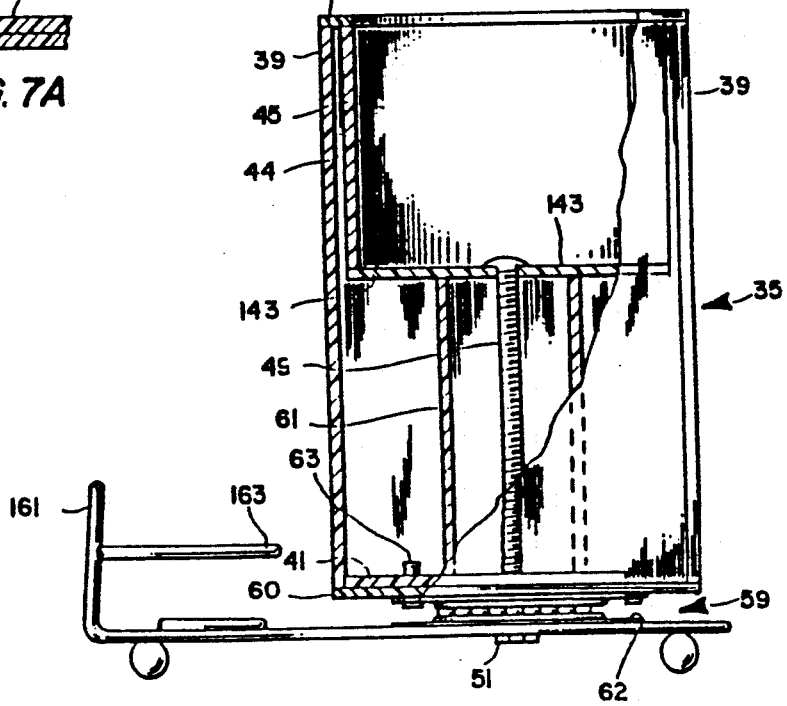

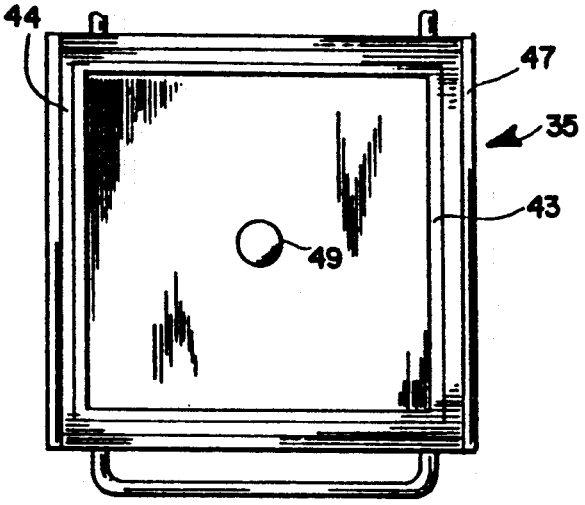
FIG. 10
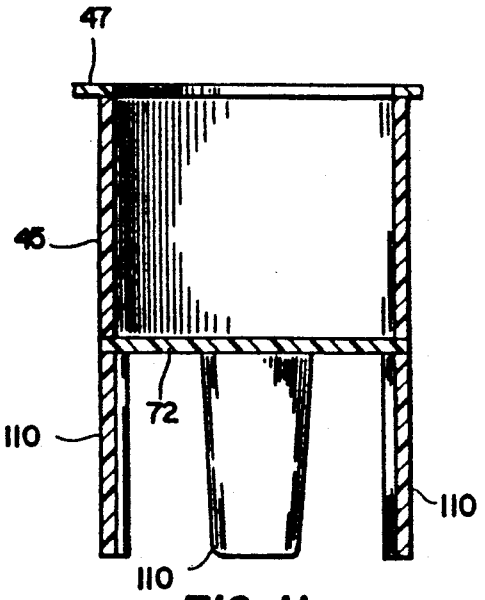
FIG. 11
FIG. 9
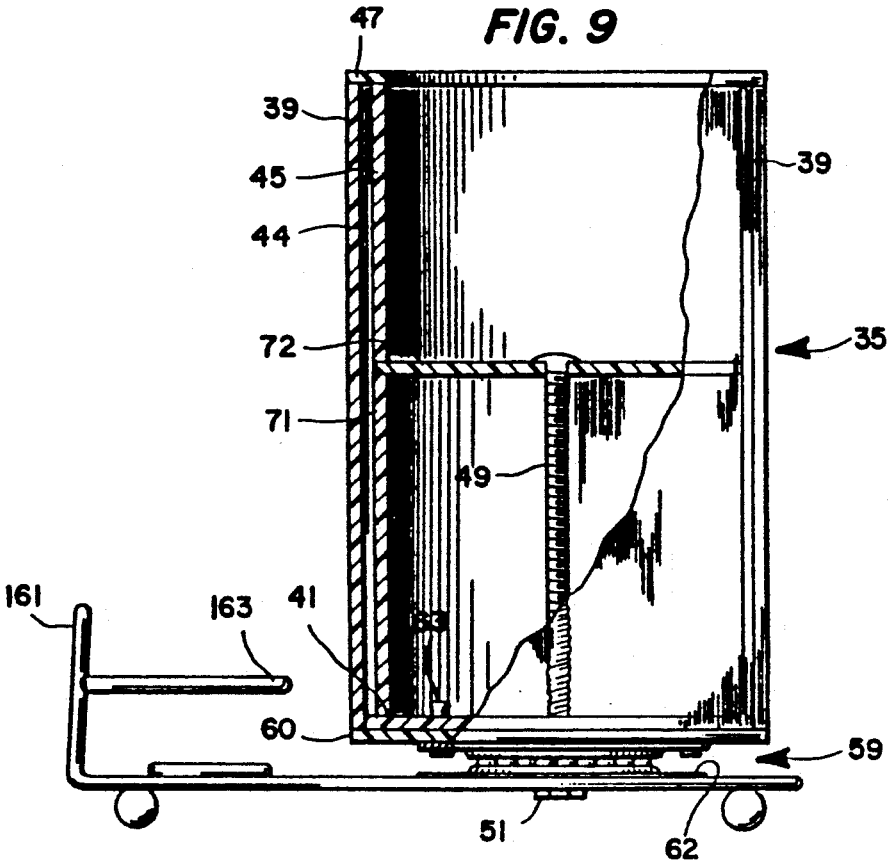

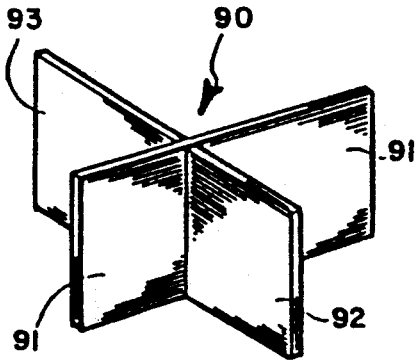
FIG. 13
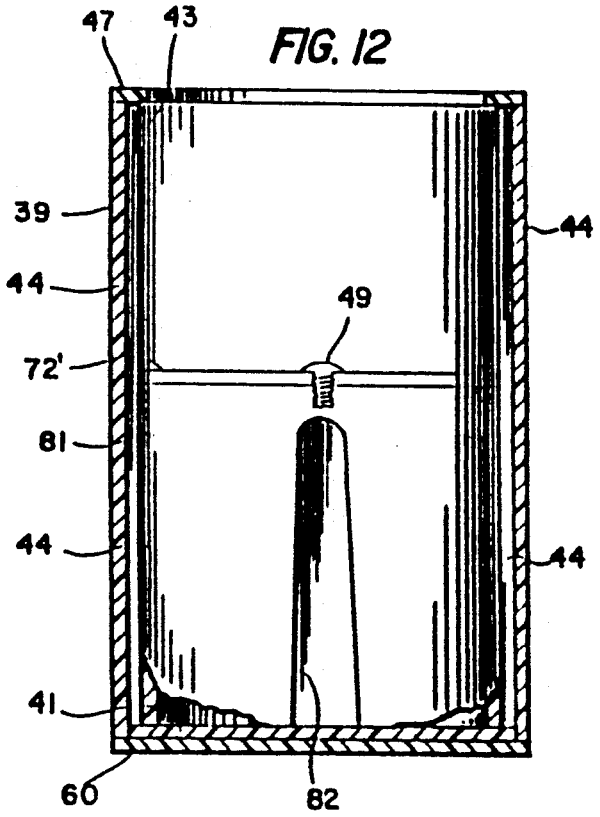
FIG. 12
FIG. 18
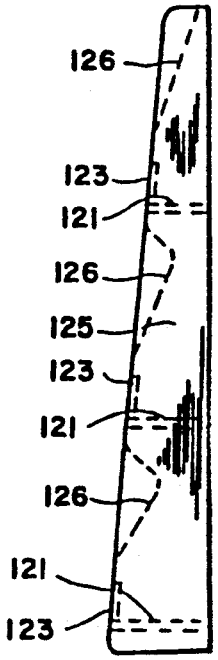
FIG. 14
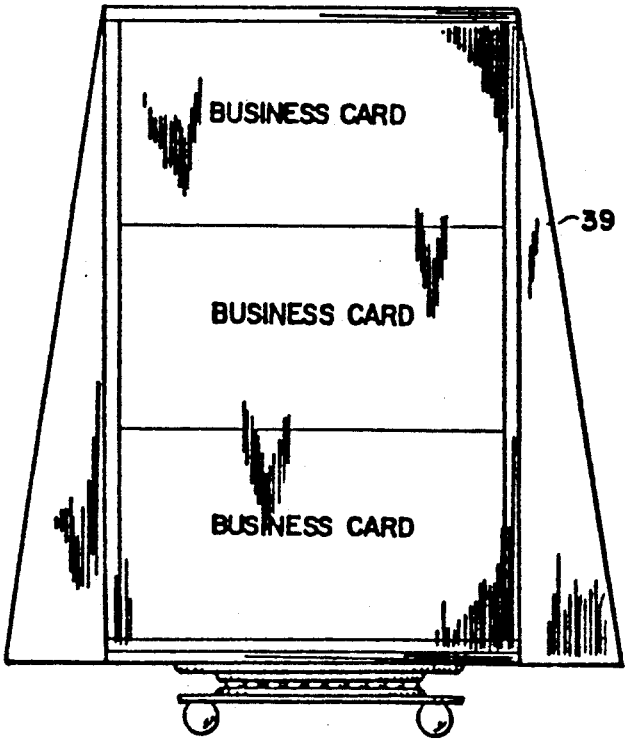

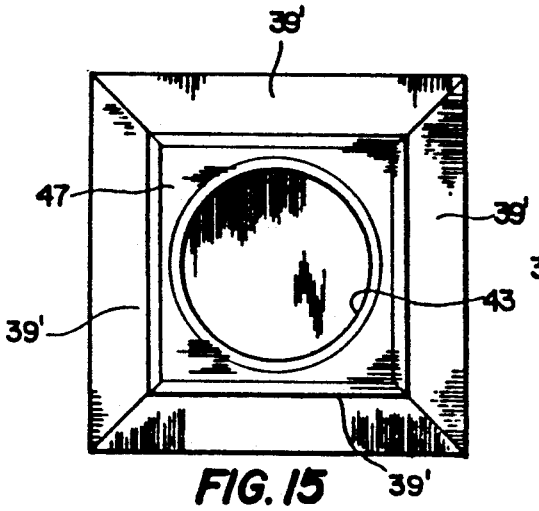
FIG. 15
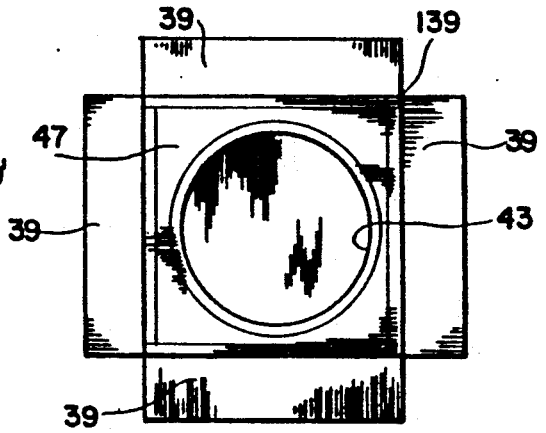
FIG. 16
FIG. 19
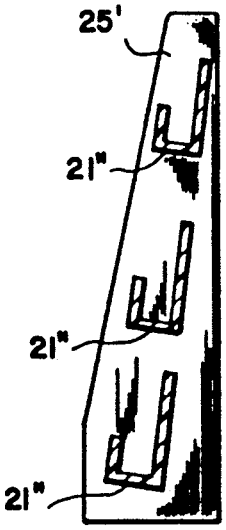
FIG. 20
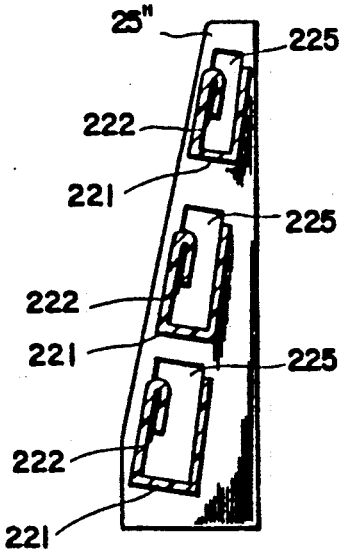

DISPLAY AND DISPENSING APPARATUS

This is a continuation of application Ser. No. 365,044, filed June 9, 1989, now U.S. Pat. No. 4,967,496, issued Nov. 6, 1990, which is a continuation of Ser. No. 125,376, filed Nov. 25, 1987, now U.S. Pat. No. 4,839,976, issued June 20, 1989, which is a continuation of Ser. No. 829,829, filed Feb. 14, 1986, now U.S. Pat. No. 4,727,666, issued Mar. 1,1988.

BACKGROUND OF THE INVENTION

This invention is directed to an advertising display and dispensing apparatus for displaying one type of item and for retaining another type of item and, more particularly, to a business card or advertising card holder for exhibiting such cards in a restaurant or other business type of environment which also includes a receptacle for retaining food or other articles which can be selectively and readily removed for use by the restaurant or other business patrons.

Some embodiments of the invention are arranged for dispensing advertising materials, such as business cards. It should be clear that the embodiment could also dispense coupons, discount cards, special entrance tickets to various events, or other advertising-type materials. However, throughout the specification, the invention is described with respect to business cards for ease of description.

Business card holders serve a useful and valuable role as an advertising medium which is inexpensive yet capable of exposing the message to many people. Such holders are regularly used in various business establishments. The advertiser can target on the group most likely to desire his services by judicious selection of the location where his cards are placed. The cards are removed by interested readers. Restaurants are a particularly good site for this type of advertising approach because the cards have a captive audience for the duration of a meal with typically little else to compete with for the attention of the dining patron. Also, at restaurants with heavy traffic the cards are subject to extensive exposure to local as well as transient patrons. However, since tabletop space is often at a premium in this environment, the card holders compete for room which the restaurant or its dining patrons may wish to put to different use. For example, the restaurant may wish to place on the table salt and pepper shakers, toothpick holders, sugar containers, ketchup bottles, etc. The patron wants the tabletop surface clear to maximize his dining comfort when the meal arrives. Thus, the business card holder may be relegated to a remote corner of the table behind other things of more direct utility to the patron and restaurant during the meal. By storing a food item used by a restaurant patron during eating, the patron is forced to notice the advertising material and/or business cards retained by the apparatus and to keep it in view.

The apparatus of the present invention can be used for other types of combined advertising displays and "goods" holder.

SUMMARY OF THE INVENTION

It is a general object of the invention to combine a business card or other advertising media holder with a receptacle to retain other articles.

A more specific object of the invention is to provide a business card holder for use in restaurants which is adapted to contain food articles for selective removal by the dining patrons.

A further object of the invention is to provide an apparatus which is relatively compact, sturdy, durable, attractive and appealing.

Yet another object of the invention is to provide a business card holder with additional means to attract attention in order to maximize its advertising value.

These and other objects of the invention are attained by an apparatus which includes an enclosure having a plurality of walls upon which the business cards can be placed. In one embodiment, the cards are arranged directly adjacent the inside surface of the walls which are, of course, transparent. In another embodiment, the cards are placed on a ledge which extends outwardly from the wall. In both embodiments, the top of the enclosure accommodates a receptacle of some sort in which a number of small food articles can be retained and from which such articles can readily be removed. The enclosure and retainer are placed on a support, such as a rotatable tray to facilitate access to both the cards and food by the dining patrons.

By containing the advertising and dining functions into a single unit in accordance with the invention, both aspects benefit. Since the space required by such an arrangement is less than that needed by one card holder and, say one sugar bowl, the convenience to the patron is increased. Moreover, the advertiser also benefits by having an article of food in the card holder because the patron is forced to look at it at some point when he requires that particular article. Also, it is less likely that the card holder will be shunted aside now that an article directly needed for the meal is incorporated into it. Reducing the required space while increasing the advertising impact are two significant advantages offered by the invention.

BRIEF DESCRIPTION OF THE DRAWINGS

The invention is directed to an apparatus which combines a business card holder with a receptacle for holding another type of article, such as food, as explained in detail below in conjunction with the following drawings:

FIG. 1 is an elevational view of the first embodiment of the invention;

FIG. 1A is a partial sectional view of a modified embodiment thereof;

FIG. 2 is a top view of the FIG. 1 embodiment;

FIG. 3 is a top view of the FIG. 1 embodiment with the food receptacle removed;

FIG. 3A and 3B are partial sectional and rear views, respectively, of a further modified embodiment;

FIG. 5 is a top view of the FIG. 4 embodiment;

FIG. 7 is a side view, similar to FIG. 6, shown partly in section, and showing a modification to the embodiment of FIG. 6;

Figure 4:
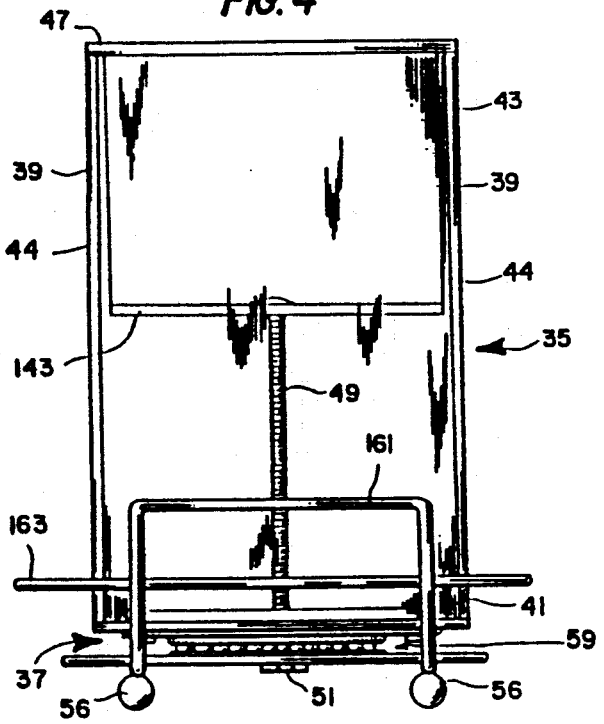
FIG. 4 is an elevational view of the second embodiment of the invention.

FIG. *7a* shows a modification of a portion of FIG. 7;

FIG. 8 is an embodiment, similar to that of FIGS. 4 and 7, but without the salt and pepper shaker holder;

FIG. 9 is a modified embodiment, similar to FIG. 7;

FIG. 10 is a top view of a modified display portion of the embodiment of FIG. 9, showing a rectangular receptacle;

FIG. 11 shows a modification of the internal structure of FIG. 9;

FIG. 12 is a part sectional view of the display portion of the apparatus of FIG. 9, showing a modified embodiment;

FIG. 13 shows a modified internal member according to the invention;

FIG. 14 shows a further modified embodiment with inclined walls for better visibility;

FIG. 15 shows a top view of one form of the FIG. 14 embodiment;

FIG. 16 shows a top view of another form of the FIG. 14 embodiment;

FIG. 17 shows a partial view of the embodiment of FIG. 1 with inclined walls;

FIG. 18 illustrates modifications to the embodiment of FIGS. 1-3; and

FIGS. 19 and 20 illustrate further modifications.

DESCRIPTION OF THE PREFERRED EMBODIMENTS

The first embodiment includes an upright enclosure 1 carried on a base or support 3. As best seen in FIGS. 2 and 3, the enclosure is pentagonal in shape in that it has five walls, 5, with adjacent walls meeting at corners 7. Top 9 rests on walls 5 and overhangs them somewhat for reasons discussed below. Top 9 has a hole 11 therein (FIG. 3) which is sized to receive body 13 of receptacle 15 (FIG. 2). Body 13 is shown in the shape of a bowl. The bowl 13 and hole 11 are relatively sized so that the bowl is a close fit in hole 11. Receptacle 15 has a rim, or flange, 17, which is larger in radius than hole 11. Thus the bottom of flange 17 rests on the upper surface of top 9. Between the tight fit of body 13 in hole 11 and the flange 17 resting on top 9 the receptacle is kept in place on the enclosure. As an option, in order to strengthen the load capacity of the receptacle for example, a support column 19 (FIG. 1) ca be provided under the bottom of body 13. Receptacle 15 may be, for example, metal or plastic (i.e., lucite). The enclosure of FIGS. 2 and 3 need not be pentagonal in shape. It could be hexagonal, rectangular, triangular, or any other desired shape.

In FIG. 1, enclosure 1 is viewed head on at a corner 7. It is readily seen that walls 5 extend to the left and right, respectively, from corner 7. Three ledges, or shelves, 21 are equally spaced in a vertical direction along each wall 5 and are attached thereto. Each of ledges 21 is horizontal and extends outwardly away from wall 5. Attached to the edge of ledge 21 remote from wall 5 is a vertical barrier 23. The length of ledge 21 and barrier 23 is slightly more than that of a business card. The maximum height (width) of barrier 23 is preferably less than half the width of a business card and its minimum height must be capable of preventing the cards from slipping off ledge 21. The number of shelves or ledges 21 can be more or fewer than 3 as shown.

FIG. 1A shows a modified embodiment wherein the ledges 21' are angled downwardly so that an acute angle is formed between ledges 21 and vertical barrier 23'. This construction keeps the business cards forward for better visibility when the ledge is partially empty. All of the ledges 21 of FIG. 1 can be angulated as shown in FIG. 1A.

To lend the necessary rigidity to the structure of FIGS. 1-3, two bracing walls 25 sandwich between them the ledges 21 and barriers 23. Bracing walls 25 extend vertically between and are connected to support 3 and top 9. Bracing walls 25 are also connected to walls 5 and extend outwardly therefrom. Bracing walls 25 and ledges 21 are of the same width. However walls 25 may taper outwardly toward the bottom as shown by modified bracing wall 125 and ledges 121 in FIG. 18. Thus, ledges 21 and barriers 23 are securely held in place by bracing walls 25. However, bracing walls 25 themselves must be affixed securely against lateral forces. If a wall 25 is pushed sideways, some means must be provided to prevent it from rotating about the point where it is attached to wall 5. Otherwise, the structure will deform resulting in the breaking of the bond between bracing walls 25 and the ledges and barriers. This is accomplished by attaching each bracing wall 25 at its bottom to support 3 and its top to the overhang 27 of top 9. Overhang 27 is provided for this purpose and also to prevent articles of food contained in receptacle 15 from falling into the card receiving areas defined by ledges, barriers 23, etc. Thus secured at its top and bottom, bracing wall 25 will resist movement under lateral forces of anticipated magnitudes, and the entire assembly has thereby acquired the requisite rigidity.

Turning now with more specificity to lower support 3 in the preferred embodiment it is disclosed as a rotatable tray sometimes known as a lazy Susan. Support 3 includes a roller bearing assembly 29 attached between bottom plate 31 and base 33. The attachment is by way of well known, conventional means such as adhesives, rivets, (i.e., pop rivets), screws, etc. Thus, no further details are deemed necessary.

All the parts of enclosure 1 are preferably made of a transparent, rigid material. Lucite is preferred because of its durability, transparency, rigidity, attractiveness, color availability and cost. With business cards placed on ledges 21, the transparency of all of the parts fully exposes the cards to view. None of the walls blocks a card from view even if the holder is turned so that the card happens to be at an angle to the viewer. The parts are attached to each other by well known, conventional means such as gluing, solvents or heat bonding and, thus, no further details are deemed necessary.

In use, a stack of business cards is placed on each of ledges 21 (or 21' as shown in FIG. 1A) where they are displayed as well as being readily available to anyone who cares to take one. Wall 5 is preferably transparent so that a card can be taped or otherwise adhered to the inner surface thereof behind a ledge 21 so as to be seen when all of the cards are removed. This also makes the device easier and more convenient to refill. The rotatability of the apparatus permits each dining person to bring each of the cards into view and into reach, and to select and remove any which are of interest. Receptacle 15 can be used to hold any one of many types of food articles such as packets of sugar, sugar cubes, toothpicks, mints, etc. The device is also preferably used at a central check-out counter where patrons can take mints or the like out of receptacle 15 and observe and remove cards of interest while a receptionist is making change, etc. The articles can be placed in the receptacle 15 while it is within enclosure 1 or the receptacle can readily be removed and taken to a central dispensing station for refill and cleaning, after which it is replaced in the enclosure.

In order to facilitate removal of the cards from the ledges, part of the side bracing walls can be cut-out, as indicated by the dashed lines 126 in FIG. 18. By cutting out sections of the bracing walls 25, 125 as indicated in FIG. 18, the cards or the like on the shelves 21, 121 can be gripped from the upper side portions thereof, to facilitate removal. The cut-outs 126 can be provided in bracing walls 125, even if they are of type shown in FIG. 1, or in any other modified embodiment.

FIGS. 3A and 3B are sectional and rear views, respectively of a modification of the circled portion of FIG. 3. In this embodiment, a rear holder 100 is provided to hold a card adjacent the inner surface of wall 5 so as to be visible through wall 5 which is preferably transparent. Rear part 100 is spaced from wall 5 by spacers 103, 104 to provide a space 101 into which to insert a card. A cut-out 102 is provided in rear part 100 for easy removal of a card. Access to the interior surfaces of walls 5 can be accomplished by removal of receptacle 15. This arrangement eliminates the need to tape a card to the inner surface of wall 5 as described above. Member 100, and spacer strips 103, 104 are adhered to the inner surface of wall 5.

The further embodiment of the invention includes a rigid enclosure 35 carried on base 37 (FIG. 4). Enclosure 35 is a rectangular box with walls 39 and bottom 41 joined together to form a solid structure with an open top. Enclosure 35 could be triangular or other polygonal shape. Rectangular is preferred for maximizing advertising space vs. table space. A receptacle 43 is sized to fit through the open top of the box. A fixed width space 44 is provided between rigid receptacle 43 and the rigid box. Receptacle 43 is preferably circular (FIG. 5) and it has a square upper flange 47 with the same peripheral shape as the box so that flange 47 sits on wall 39. A screw 49 is provided to secure the receptacle in place during use. As best shown in FIGS. 4 and 7, screw 49 passed through a hole (not shown) in the bottom of the receptacle 43, through a hole (not shown) in the bottom of the box, and through support 37. Nut 51 is threaded onto screw 49 and tightened. A split or lock washer can be used. Thus, the receptacle is held to the enclosure 35 by the force exerted between wall 39 and flange 47 at its top and the screw head at its bottom. Receptacle 43 may be other than round, for example, rectangular.

The walls 39 are transparent and can be made, for example, of Lucite material, as discussed above with regard to the first embodiment. The walls and bottom are attached or adhered (i.e., by a solvent type adhesive) to each other in a well known manner and, thus, no further details are deemed necessary.

The lower flange 143 of FIGS. 4 and 7, and of the other similar embodiments, is preferably rectangular so as to define space 44 along the interior walls 39 of the enclosure 35. Rectangular flanges 143 provide support along substantially the complete width of the walls 39. However, the flanges 143 can be round or any other shape, as desired.

Figure 6:
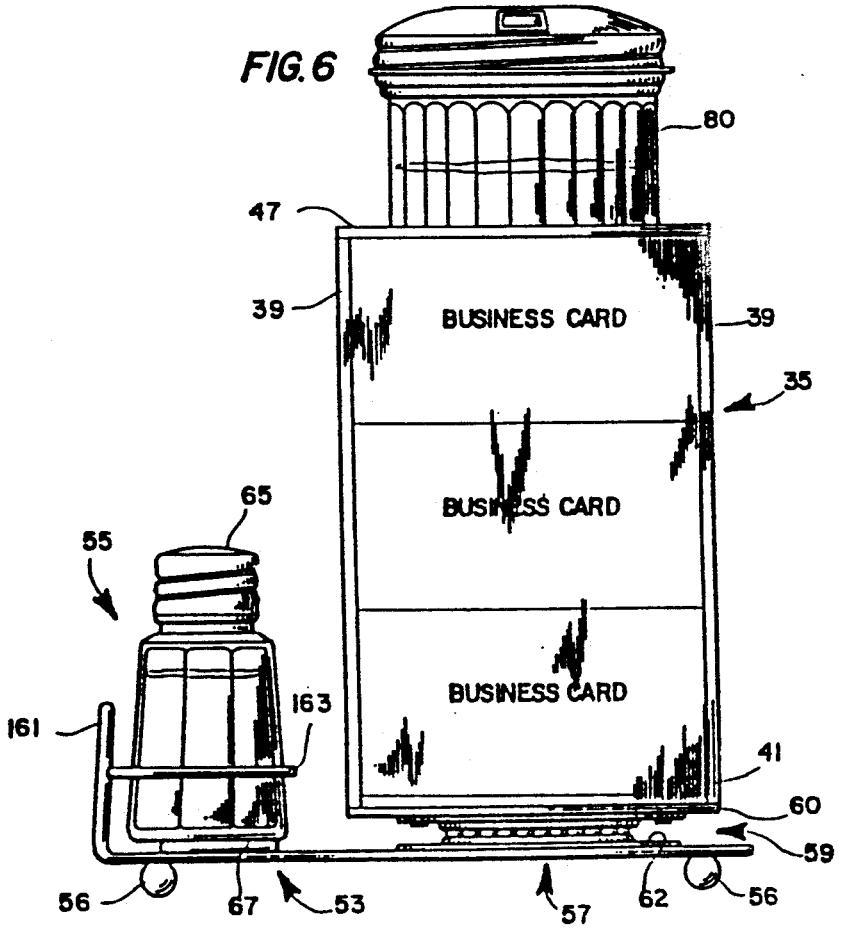
FIG. 6 is a left side view of the FIG. 4 embodiment showing business cards, a sugar dispensing bottle, and a salt shaker as part of the unit.

In use, the business cards are removably inserted adjacent the inner side of wall 39. See FIG. 6. This can be done quite easily by unscrewing nut 51 and then simply lifting receptacle 43 and the box 35 off of the base. In this condition, the interior of the box is readily accessible for inserting, securing or removing the cards. One manner of securing the cards in place is to tape together three cards (in the illustrated embodiment) on their rear sides, and to then place the resulting assembly of three cards inside of one of the walls, as seen in FIG. 6. This can be done for all four walls. The assembly of the taped together cards fits loosely in the fixed-width space 44 (see FIG. 4) so that the cards are loosely retained in place between the rigid outer surface of the receptacle 43 and the rigid inner surface of a wall 39. This prevents collapsing of the cards. The cards may also be taped to the walls 39 or the sizing of the cards can be such that the cards can be force fit with their opposing vertical sides held in place by friction against opposing walls 39. Instead of cards connected together, larger one-piece, two-piece, etc. advertising media can be placed in space 44. Of course, with this embodiment the cards are not removable by the dining patron. The receptacle can hold, for example, a sugar dispensing bottle 80 (see FIG. 6), packets of sugar or sugar substitute (see FIG. 8), a ketchup or mustard dispenser, a removable bowl such as shown in FIG. 2, etc.

FIG. 7 shows a further modified embodiment which comprises a cylindrical member 61 provided below the receptacle 45 for further support and structural integrity. The cylindrical member 61 can be held in place by the pressure exerted by the screw 49 and nut 51, or it can be adhered (i.e., glued) to the lower surface of receptacle 45. The member 61 need not be cylindrical; it can be rectangular, oval or any other desired shape, or can be substantially solid with a bore extending therethrough for receiving screw 49. FIG. 7 also illustrates the rivets 63 (such as pop-type rivets) which are particularly convenient for securing the rotatable tray (lazy Susan) to the bottom of the box 35.

To add to the dispensing advantages offered by the above-disclosed apparatus, the embodiment of FIGS. 4–7 is combined with a salt and pepper shaker holder 53. Holder 53 is constructed of suitably bent rods and, as best seen in FIG. 6, has a retaining portion 55 and a base portion 57 on legs 56. The business card holder is affixed to the latter via a lazy Susan 59. The lazy Susan includes a roller bearing assembly connected between a bottom plate 60 and base 62. The attachments are made in conventional fashion (i.e., by rivets, etc. and welding; i.e., base 62 to base portion 57) and no further details are, therefore, deemed necessary. Retaining portion 55 includes vertical grip 61, best seen in FIGS. 4 and 5, which can be grapsed to move the assembly. Attached to grip 61 is holder 63, best seen in FIGS. 5 and 6, which is shaped to accommodate the salt and pepper shakers 65 (FIG. 6). The latter are placed on resting rods 67 best seen in FIGS. 5 and 6.

It must be noted that holder 63 is advantageously bent at 69 to minimize the size of the apparatus while enabling the unhindered rotation of the enclosure 35. The bend at 69 has been formed so that sufficient clearance is provided for the corners of the enclosure to rotate by unhindered FIG. 7*a* shows a modification of the circled portion of FIG. 7. The upper sheet-like member 41' of the bottom plate 60 terminates short of the walls 39 on all four sides. This creates a space 44*a* into which a lower edge of a card or other advertising media is received. This more securely holds the cards or the like in place during use and/or transporting of the device from one place to another. The space 44*a* can be provided for all of the embodiments of FIGS. 4–13.

FIG. 8 shows a modified embodiment which omits the salt and pepper shaker holder. In the FIG. 8 embodiment, like parts in FIGS. 4–7 are given the same reference numerals for ease of understanding. As seen in FIG. 8, the box 35 is mounted directly to the rotatable lazy Susan structure 59, for example, by rivets 63. The base 62 of the lazy Susan 59 is connected to leg or support members 66, for example, by welding. The device of FIG. 8 is used in the same manner as the device of FIGS. 4–7, in that business cards are arranged therein and the device is placed on a table, whereby viewers can observe the business cards mounted therein. In the device of FIG. 8, packets of sugar or sugar substitute are shown mounted in the receptacle 43 by way of example.

FIG. 9 is a modified embodiment, similar to FIG. 7, but wherein the cylindrical member 61 is replaced by a larger cylindrical member 71 which has substantially the same circumference as receptacle 45. The cylindrical member 71 may be secured in place by means of pressure exerted by tightening the screw 49, or it may be adhered to the lower surface of the horizontal member 72 of receptacle 45. Horizontal member 72 can be rectangular, round, or any other shape in order to define space 44. When horizontal member 72 is rectangular, space 44 is defined over substantially the complete width of the walls 39. Alternatively, the receptacle 45 and the cylindrical member 71 may be a single cylindrical member, and the horizonal portion 72 can be a disc-like member placed interior of the single unitary cylindrical member and adhered thereto, for example, by means of an adhesive, solvent, or the like. Other means of attaching such a cylindrical disc 72 to the interior of a unitary cylindrical member could be provided.

An advantage of the arrangement of FIG. 9 is that the space 44 is provided throughout the entire height of the display device, thereby more positively retaining business cards or other advertising media in place. I should be clear that the space 44 is defined between the rigid outer walls 39 of the display device, and the rigid cylindrical members 45, 71. This arrangement provides an apparatus in which insertion and removal of cards is easy, but which still retains the advertising media in position.

The top view of the display member of FIG. 9 is identical to that shown in FIG. 5. The differences between the FIG. 5 and 7 embodiments and the FIG. 9 embodiment is internal construction, not external construction.

FIG. 10 shows a modified arrangement wherein the receptacle 45 is rectangular in shape. In this arrangement, the side walls of the receptacle 45 (seen in FIGS. 7 and 9) are also rectangular. In the embodiment of FIG. 9, the member 71 can either be cylindrical as described hereinabove, or rectangular to conform to the shape of the rectangular receptacle 45 of FIG. 10. In the rectangular arrangement, the space 44 is defined between substantially flat surfaces, and the result is a substantially rectangular space 44 which extends around the display device for receiving business cards or other advertising media. The rectangular receptacle configuration of FIG. 10 is equally applicable to the embodiments of FIGS. 4–8.

FIG. 11 shows a modification of the interior portion of the device shown in FIG. 9. In FIG. 11, the member 71 is replaced by segmented members 110 which may be arcuate (as shown), flat, rod-shaped, elongated, etc. The critical feature is that members 110 or their equivalents be substantially rigid and spaced from walls 39 to create the fixed-width card receiving spaces 44. Horizontal member 72 could be rectangular or any other shape, as previously mentioned. When horizontal member 72 is rectangular, the segmented members 110 are preferably flat so that they provide support to the business cards or other advertising media over a wider surface area.

FIG. 12 is a partial sectional view of only the display portion of an embodiment similar to FIG. 9, but comprising an internal cylindrical member 81 which replaces the cylindrical member 71 of the embodiment of FIG. 9, and the cylindrical receptacle 45 of the embodiment of FIG. 9. The horizontal member 72′ corresponds to the horizontal member 72 of FIG. 9. The screw 49 is only partially shown in FIG. 12. Also, the rotating support member 59 is not shown in FIG. 12 for the sake of clarity.

In the embodiment of FIG. 12, the cylindrical member 81 has a cut-out portion 82 which is elongated and extends vertically of the cylindrical member 81. The purpose of the cut-out portion 82 is to provide a "finger slot" for removing advertising media for business cards from the space 44. It should be clear that if the internal member 81 is cylindrical, four such slots 82 are provided at substantially equally spaced portions around the periphery thereof so that each slot 82 is in registration with a respective side wall 39 of the display device. In a further modified arrangement, the member 81 can be made generally rectangular (so that the top view will appear as in FIG. 10). Alternatively, member 43 can be round and horizontal member 72′ and/or member 81 can be rectangular or any other desired shape. The particular shape of the members is not extremely critical, but it is preferred that at least one of horizontal member 72′ and internal member 81 be rectangular for improved definition of the space 44 to support the cards or advertising media. In this case, each wall of the rectangular member 81 will contain a cut-out portion 82 for ease of removal of cards or advertising media in the respective spaces 44. As should be clear, in FIG. 12, the outer walls 39 are shown in section, as are the lower members 41 and 60, whereas the member 81 is not shown in section. Cut-out portions or slots 82 may be wider than shown, differently shaped, etc. Lower groove or space 44*a* can be provided, as shown in FIG. 7A.

The embodiment of FIG. 12 can be further modified to include an internal construction as shown in FIG. 9 (that is, the receptacle 45 has a lower cylindrical (or rectangular) member 71 placed below it). In such a case, the lower member corresponding to the member 71 can be removable, or can be adhered to the lower portion of receptacle 45.

FIG. 13 illustrates an X-shaped member 90 which can replace the cylindrical member 71 of FIG. 9 of the cylindrical member 61 of FIG. 7. The X-shaped member 90 is non-symmetrical so that a central space will be provided for screw or bolt 49 to pass downwardly from the horizontal support member to the base member 60. The X-shaped member 90 can be fabricated of three separate members 91, 92, 93 adhered together to form the generally X-shaped configuration. Alternatively, the member 91 can have a slot extending halfway therethrough, and the members 92, 93 can be formed in a single piece having a slot extending halfway therethrough, the slots of the members being interengageable so that they can be arranged to form the X-shaped configuration of FIG. 13. In a preferred arrangement, the X-shaped configuration is arranged interior of the outer walls 39 of the display device, with each leg of the X-shaped member substantially perpendicular to the interior surface of one of the outer walls 39, and arranged at substantially the central portion of the respective outer walls 39. The spacing between the ends of the legs 91, 92, 93 is sufficient to provide said space 44 between the outer vertical extremities of the legs 91, 92, 93 and its respective associated wall 39. Thus, the X-shaped configuration not only helps support the receptacle 45, but also provides a retaining space 44 to more positively retain business cards and/or advertising media in the display device. The legs of the X-shaped member 90 can be other than perpendicular.

FIG. 14 shows an embodiment, similar to FIG. 8, but wherein the walls 39 are inclined outwardly for better visibility of the advertising media. The walls 39 can be arranged as shown in top view in FIG. 15. In FIG. 15, the walls 39 are rectangular and corner interconnections 139 are provided. The walls could be arranged as in FIG. 16 wherein the walls 39' are trapezoidal and meet at their upwardly directed edges. The internal members, of course, are correspondingly angulated to provide spaces 44 for supporting cards or the like.

In all of the embodiments of FIGS. 4–16, the space 44 is defined between respective rigid members, and is sufficiently wide so that cards or the like can be easily inserted and removed. Preferably, the space 44 has a width of more than one thicknesses of the cards or the like (i.e., 2–5 or more thicknesses). Space 44 can be one "thickness" wide, but the cards or the like may be more difficult to insert and/or remove.

FIG. 17 shows a simplified view through a vertical wall 5 of the FIG. 1 embodiment showing an inclined wall 5' with downwardly angulated shelves 21' thereon. All of the walls 5 of FIG. 1 can be so inclined. This arrangement provides for better visibility of the lower cards and easier removability of lower cards. The angle of inclination can be, for example, 5°–45° relative to the vertical.

FIG. 19 shows a modification of the embodiment of FIGS. 1–3. Referring to FIG. 19, the side walls 25' replace a pair of opposed side walls 25 which have shelves therebetween. The shelves in this embodiment are generally "J" shaped shelves 21'' which have bottoms which are angulated slightly upward, for example between 5 and 25 degrees. The shelves 21'' extend between a pair of spaced apart side walls 25'. When the embodiment of FIG. 19 is applied to FIGS. 1–3, the result is a configuration with five vertical walls, each wall being provided with a pair of spaced apart projecting walls 25' and associated shelves 21''. In this embodiment, the shelves 21'' are stepped outwardly so that the user can more easily remove business cards from the lower shelf. This also makes the business cards in the lower shelves more visible than in the strictly vertical arrangement of FIGS. 1–3. Also, the cards in the lower shelves are more readily removable since they are stepped outwardly. By angulating the lower surfaces of the shelves 21'', the business cards are angled upward toward the viewer, and can be more readily seen. As should be apparent, the J-shaped shelves 21'' are elongated members which extend between a pair of side walls 25', as shown by corresponding elements 25 and 21 in FIGS. 1–3.

FIG. 20 shows a further modified embodiment wherein the spaced apart side walls 25'' have openings 225 therein for removal of business cards from the sides of the walls 25''. In this embodiment, the shelves 221 are generally U-shaped elongated members which extend between a pair of side or bracing walls 25'', in a manner similar to shelves 21 extending between side walls 25 in the embodiment of FIGS. 1–3. In this embodiment, the shelves 221 are stepped outwardly as in the embodiment of FIG. 19 and the shelves are rearwardly inclined, as in the embodiment of FIG. 19. The shelves 221 each have card receiving slots 222 in the front wall portion thereof. The shelves 221 are made of transparent material so that a business card, inserted in slot 222, can be seen from the outside by a viewer. If the viewer wishes to remove a business card from the respective shelf, the viewer inserts a finger through the opening 225 in the side or bracing wall 25'' to remove a business card. The openings 225 can be provided on one or both of the opposed side walls which support a respective 3 shelves 221.

While specific embodiments of the invention have been disclosed in detail above, it should be apparent that certain modifications to these will be readily apparent. For example, the number of sides selected for the business card holder is arbitrary. Also, in the first embodiment, ledges 21 and bracing walls 25 need not be attached to walls 5. Furthermore, not all of the parts in this embodiment need to be transparent. In particular, walls 5, 25 can be made of an opaque material. Likewise, the entire circumference of overhang 27 need not overhang walls 5 or it can overhang walls 5 by a greater degree than shown. It would be sufficient to merely provide sufficient area for the bracing walls to contact. Also, a means to firmly secure receptacle 15 to enclosure 1 could be provided. In addition, for the second embodiment, the head of screw 49 can be recessed into the bottom of the receptacle. Also, for both embodiments, the shape and size of the receptacles is merely a matter of design choice based on appearance and/or utility. These and other such modifications are intended to and do form a part of the invention and are included within the scope of the invention as defined by the following claims.

I claim:

1. Apparatus for displaying items having visual indicia thereon and also for containing articles available for selective removal therefrom, comprising:

a substantially upright enclosure with substantially upright, substantially transparent side walls, and a top having an opening therein;

a side wall surface of said enclosure adapted to retain and exhibit said items;

an open-top receptacle accommodated in the top portion of said enclosure and extending downwardly from said opening, for holding said articles in a manner suitable for convenient removal of said articles therefrom by hand through said open top of said receptacle;

means for removably securing said open-top receptacle to said enclosure without closing the open top of said receptacle; and a space defined between inner surfaces of said side walls and said receptacle, said items being at least partly received in said space and supported by at least one of said receptacle and an inner surface of said side walls.

2. The apparatus of claim 1, wherein said receptacle is of a size to fit in said enclosure and has an upper rim sized to be fitted on the top of said side walls.

3. The apparatus of claim 1, further comprising rotating means on which said enclosure is mounted, whereby said enclosure is rotatable.

4. The apparatus of claim 1, further comprising support means on which said enclosure is mounted.

5. The apparatus of claim 4, wherein said support means includes rotatable means for mounting said enclosure so that said enclosure is rotatable relative to said support means.

6. The apparatus of claim 4, wherein said support means includes a holder for small containers.

7. The apparatus of claim 1, wherein said receptacle extends only partly through the height of said enclosure.

8. The apparatus of claim 7, further comprising a support member mounted in said enclosure and below said receptacle for providing support for said receptacle.

9. The apparatus of claim 8, wherein said support member comprises a substantially cylindrical member of substantially the same peripheral shape as said receptacle, a space being defined between inner surfaces of said side walls of said enclosure and said support member, said items being at least partly received in said last mentioned space.

10. The apparatus of claim 8, wherein said support member comprises a substantially rectangular member of substantially the same peripheral shape as said receptacle, a space being defined between inner surfaces of said side wall of said enclosure and said support member, said items being at least partly received in said last mentioned space.

11. The apparatus of claim 8, wherein said support member comprises a generally X-shaped member extending between a lower surface of said receptacle and a lower surface of said enclosure.

12. The apparatus of claim 11, wherein said X-shaped support member has substantially vertical edges spaced from inner surfaces of said side walls of said enclosure and defining spaces relative to said walls of said enclosure, said items being at least partly received in said last mentioned spaces and supported at least partly by at least one of said substantially vertical edges and said inner surfaces of said walls.

13. The apparatus of claim 1, wherein said enclosure comprises a base, said base including means defining a groove between the inner surfaces of said side walls and a portion of said base for receiving sheet-like items in said groove, thereby further supporting and retaining said sheet-like items.

14. The apparatus of claim 1, wherein said upright substantially transparent side walls are downwardly and outwardly inclined from the top of the enclosure toward the bottom of the enclosure.

15. The apparatus of claim 1, further comprising retaining means extending downwardly from said receptacle and spaced from at least a portion of respective side walls of said enclosure so as to define respective spaces between said retaining means and the inner surface of said side walls, said items being at least partly received in said last mentioned space and supported at least partly by at least one of said retaining means and said inner surfaces of said side walls.

16. An apparatus for holding at least one item having indicia thereon and available for selective removal therefrom, and for visually displaying a member carrying indicia thereon corresponding to said at least one item, comprising:

a substantially upright structure having a surface upon which said at least one item can be placed for selective removal;

said structure including at least one wall, and said surface upon which said at least one item can be placed for selective removal thereof comprising at least one ledge connected to and extending outwardly from said at least one wall; and wherein said at least one wall is substantially transparent and wherein said structure further comprises means for removably retaining said member carrying said indicia corresponding to said at least one item adjacent an inner surface of said at least one wall and arranged behind said at least one ledge, whereby said indicia corresponding to said at least one item is viewable through said substantially transparent wall from the outside of said structure when all of said at least one item are removed from said at least one ledge, thereby providing a permanent display of said indicia corresponding to said at least one item even when all of said at least one item are removed from said at least one ledge.

17. The apparatus of claim 16, further comprising a pair of vertical bracing walls extending outwardly from said at least one wall, said at least one ledge being attached to and between said pair of bracing walls, a plurality of said ledges being attached to said bracing walls in the vertical direction, said ledges being spaced apart in said vertical direction, whereby said bracing walls secure said ledges in their respective positions.

18. The apparatus of claim 16, wherein said items are substantially flat, and said retaining means of said structure are slot-like.

19. The apparatus of claim 18, wherein said items are sheet-like.

* * * * *